US005772462A

United States Patent [19]

Osten

[11] Patent Number: 5,772,462

[45] Date of Patent: Jun. 30, 1998

[54] CORD CONNECTOR

[76] Inventor: Frederick F. Osten, 11633 239th St. North, Scandia, Minn. 55073

[21] Appl. No.: 699,500

[22] Filed: Aug. 19, 1996

[51] Int. Cl.[6] ..... H01R 13/62

[52] U.S. Cl. ..... 439/367; 439/369

[58] Field of Search ..... 439/369, 363, 439/367, 368, 370, 373, 357; 24/30.5 R, 129 R, 129 W, 715.4

[56] References Cited

U.S. PATENT DOCUMENTS

| | | | |
|---|---|---|---|
| 3,029,408 | 4/1962 | Anderson | 339/75 |
| 3,193,309 | 7/1965 | Morris | 285/27 |
| 3,484,736 | 12/1969 | Wyse . | |
| 3,609,638 | 9/1971 | Darrey . | |
| 4,097,164 | 6/1978 | Campbell | 24/115 A |
| 4,643,505 | 2/1987 | House et al. | 439/368 |
| 4,749,373 | 6/1988 | Brekosky et al. | 439/595 |
| 4,940,424 | 7/1990 | Odbert . | |
| 4,998,896 | 3/1991 | Lundergan | 439/595 |
| 5,217,387 | 6/1993 | Hull et al. . | |
| 5,259,782 | 11/1993 | Giffin . | |
| 5,342,212 | 8/1994 | Francis . | |
| 5,505,634 | 4/1996 | Osten | 439/369 |

*Primary Examiner*—Neil Abrams
*Assistant Examiner*—Katrina Davis
*Attorney, Agent, or Firm*—Jacobson & Johnson

[57] ABSTRACT

A cord connector having a pair of substantially hollow receptacle-like members, with each of the members having a side wall and a first end with a plurality of resilient fingers cantilevered from the end, with the plurality of resilient fingers positioned at an acute angle to the side wall so that axial displacement of an electrical plug into the substantially hollow receptacle-like member can force the plurality of resilient fingers radially outward to permit passage of the electrical plug past the resilient fingers and into the substantially hollow receptacle-like member and thereby allow the resilient fingers to flex radially inward and engage a rear portion of the electrical plug. The resilient fingers having sufficient stiffness so that when the electrical cord connected to the electrical plug is pulled, the resilient fingers engage the electrical plug and prevent withdrawal of the electrical plug from the substantially hollow receptacle-like member.

10 Claims, 2 Drawing Sheets

CORD CONNECTOR

FIELD OF THE INVENTION

This invention relates generally to an electrical cord connector for holding together a male electrical plug and a female electrical plug and, more specifically, to such a connector which permits axial insertion of an electrical plug therein but prevents axial withdrawal of the electrical plug therefrom.

BACKGROUND OF THE INVENTION

The male and female ends of mating electrical cords are held together by a friction fit. Such a connection is relatively loose and can be pulled apart if one pulls on the cords. The present invention provides apparatus for tightly securing the ends of mating electrical cords to each other and is particularly well suited for use with electrical cords having permanently attached male or female plugs.

Description of the Prior Art

The Griffin U.S. Pat. No. 5,259,782 shows an electrical connector jacket that includes first and second housings for surrounding and holding the plug and receptacle. Each of the housings further includes two like halves that interlock with each other to surround the respective plug or receptacle.

The Odbert U.S. Pat. No. 4,940,424 shows an electrical plug accessory that includes two cylindrical members which engage one another with protuberances on one member sliding and latching in grooves in the other.

The Ryan U.S. Pat. No. 4,784,612 shows an electrical plug holder that includes a pair of hollow members, each capable of accommodating a plug. The members each have an open end through which a plug can be accessed, and a substantially closed end with a slot extending from the closed end to the open end, through which slot the electrical cord can be passed.

The Darrey U.S. Pat. No. 3,609,638 shows an extension cord coupling clamp that has a pair of spring-loaded, butterfly-type clamps which clamp on the cord ends, the clamps being mounted on a threaded, roughened, or serrated rod to thereby hold them against relative displacement.

The Wyse U.S. Pat. No. 3,484,736 shows a quick disconnector which has an automatic disconnect capability when a preset tension is supplied to the connectors, such as when a small guided missile is to be fired from an aircraft or a booster rocket is to be detached and jettisoned during the launch of a space craft.

The Anderson U.S. Pat. No. 3,029,408 shows an extension cord clamp formed of two members of bent wire construction which cooperate with a channel-shaped clamp.

The Osten U.S. Pat. No. 5,505,634 shows a cord connector for holding together a male and female electrical plug.

The Morris U.S. Pat. No. 3,193,309 shows a connector with spiral retaining means.

The Hull et al. U.S. Pat. No. 5,217,387 shows a water resistant extension cord housing that opens longitudinally. The Francis U.S. Pat. No. 5,342,212 shows a plug protective cover in the shape of a funnel.

BRIEF SUMMARY OF THE INVENTION

Briefly, the present invention comprises a cord connector for holding together a male electrical plug and a female electrical plug. The cord connector includes first and second substantially hollow receptacle-like members, with each of the members having a side wall and a first end with a plurality of resilient fingers cantilevered from the end, with the plurality of resilient fingers positioned at an acute angle to the side wall so that axial displacement of an electrical plug into the substantially hollow receptacle-like member can force the plurality of resilient fingers radially outward to permit passage of the electrical plug past the resilient fingers and into the first substantially hollow receptacle-like member and thereby allow the resilient fingers to flex radially inward and engage a rear portion of the electrical plug, with the resilient fingers having sufficient stiffness so that when the electrical cord connected to the electrical plug is pulled the resilient fingers engage the electrical plug and prevent withdrawal of the electrical plug from the substantially hollow receptacle-like member.

DESCRIPTION OF THE PREFERRED EMBODIMENT

Figure 1:
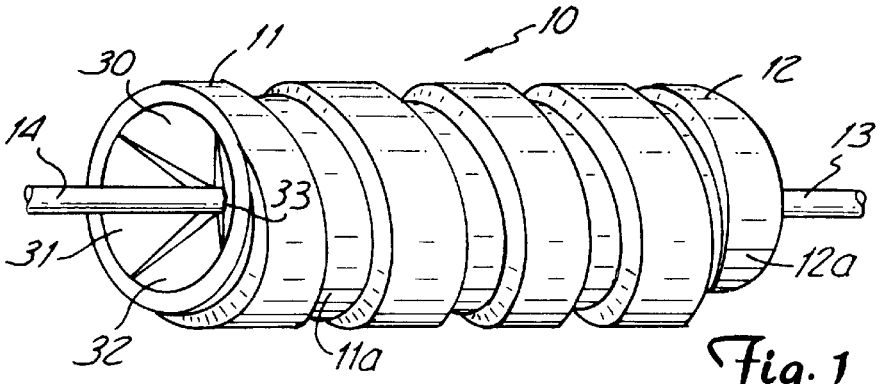
FIG. 1 shows a perspective view of the cord connector with electrical cord end portions extending from either end of the invention.

Referring to FIG. 1, reference numeral 10 generally identifies my cord connector. The connector 10, includes a one-piece female member 11, having a side wall 11*a* shaped in the form of a thread and being threadably engaged to a one-piece male member 12 having a side wall 12*a* which is also formed in the shape of a thread. The outside surface of each of the side walls 11*a* and 12*a* is formed in the shape of a male thread, and the inside surface of each of the side walls 11*a* and 12*a* is formed in the shape of a female thread.

Figure 2:
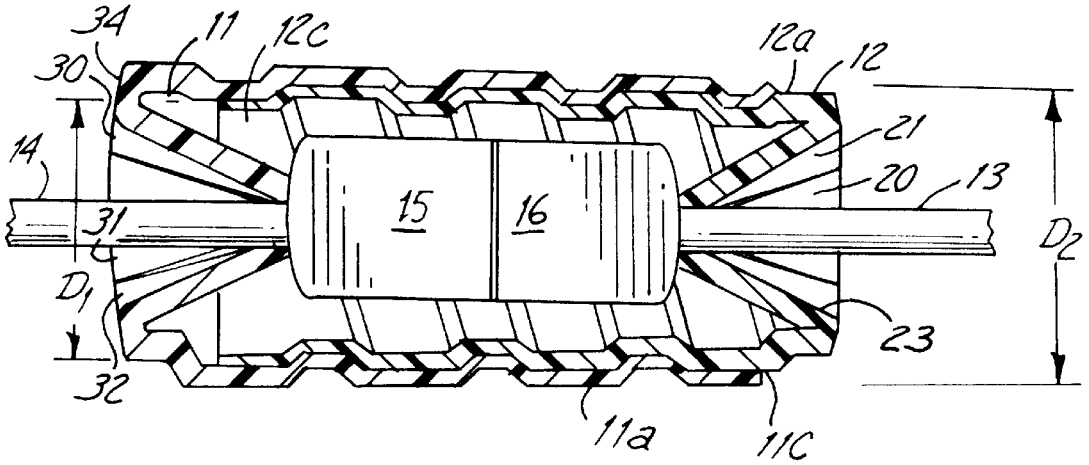
FIG. 2 shows a section view of the cord connector of FIG. 1.

Referring to FIG. 2, each of the one-piece members 11 and 12 has a respective open end 11*c*, 12*c*. Each of the one-piece members 11, 12 is substantially hollow and forms a receptacle-like member. Further, each of the members is, to the eye, substantially cylindrical. However, the side walls 11*a*, 12*a*, are actually slightly conical in shape.

Referring to FIGS. 1 and 2, a first end portion 13 of a first electrical cord extends into the male member 12 and a second end portion 14 of a second electrical cord extends into the female member 11. The electrical cord second end portion 14 is affixed to a female electrical plug 15 and the electrical cord first end portion 13 is affixed to a male electrical plug 16. The male electrical plug 16 includes electrical prongs 16*a* (FIG. 5) for mating with the female electrical plug 15.

FIG. 2 shows that male member 12 is smaller than female member 11 with the open end 12*c* of the male member 12 having an outer diameter, $D_1$, with the open end 11*c* of the female member 11 having an inner diameter, $D_2$. In their unengaged positions, $D_1$ of the male member is less than $D_2$ of the female member to permit the members to be threadably engageable. The feature of the engageable members is more fully described in my U.S. Pat. No. 5,505,634.

Figure 3:
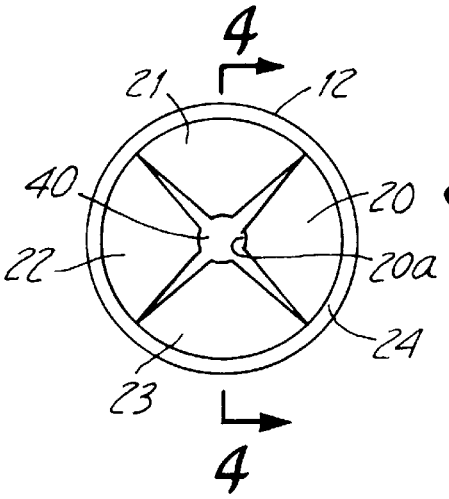
FIG. 3 shows an end view of the cord connector of FIG. 1.

FIG. 3 shows an end view of cord connector member 12 showing fingers 20, 21, 22 and 23 made of resilient cone segments and positioned in an unflexed condition. Fingers 20, 21, 22 and 23 are cantilevered from lip 24 of substantially hollow receptacle-like member 12 and extend inward into the cavity in member 12 with the fingers 20, 21, 22 and 23 and the receptacle-like member 12 of unitary construction. A suitable material for use in the present invention is a polymer plastic such as PVC.

Figure 4:
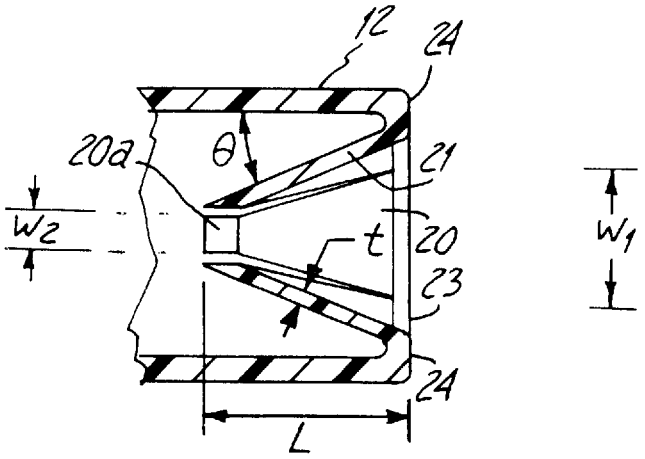
FIG. 4 shows a partially cut-away, section view of the cord connector of FIG. 1.

FIG. 4 shows fingers 20, 21, 22 and 23 each extend a distance "L" into connector 12 with the fingers 20, 21, 22 and 23 having a thickness "t" and forming an angle Ø with respect to the sidewall of connector 12. In the embodiment shown, the four fingers 20, 21, 22 and 23 and the connector 12 form an integral one piece construction that extends inward from the lip 24 in the shape of a cone. Finger 20 is shown having a base width indicated by "$w_1$" and an apex width indicated by "$w_2$". Finger 20 includes a cord engaging area 20 that is radially offset from the axial center of the cord connector. As each of the other fingers are identical in size and shape they will not be described. FIG. 3 shows that when the fingers 20, 21, 22, and 23 are in the normal condition, they coact to define a central opening 40 for an electrical cord.

FIGS. 1 and 2 show that the substantially hollow receptacle-like member 11 includes four fingers 30, 31, 32 and 33 which comprise a resilient, cone segment with the base end of the segment cantilevered from the end of member and the apex end of the segment extending axially and radially inward of member 11. Similarly, fingers 30, 31, 32 and 33. are cantilevered from lip 34 of substantially hollow receptacle-like member 11 and extend axially and radially inward into the cavity in member 11. As fingers 30, 31, 32 and 33 are identical to fingers 20, 21, 22, and 23, the fingers will not be described.

Figure 5:
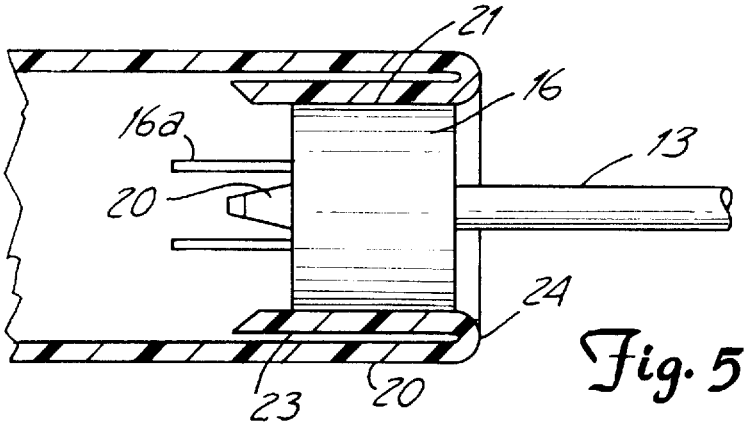
FIG. 5 shows an electrical plug being inserted into the cord connector of FIG. 1.
Figure 6:
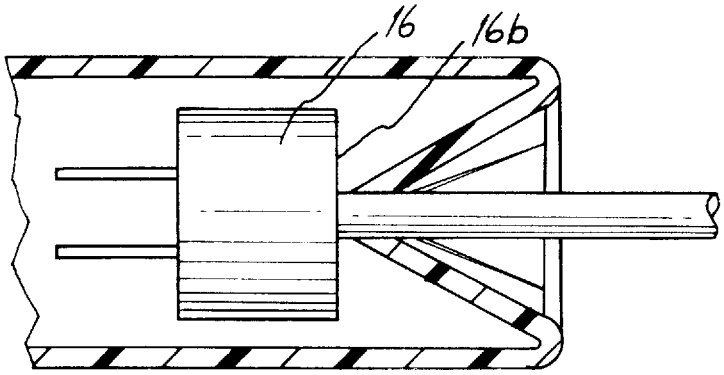
FIG. 6 shows an electrical plug restrained from withdrawal from the cord connector of FIG. 1.

In order to appreciate the operation of the present invention, reference should be made to FIG. 5 and FIG. 6. FIG. 5 shows the fingers in the flexed condition with a male plug 16 being inserted axially into member 12. That is, the plurality of flexible fingers 20, 21, 22 and 23, which are positioned at an acute angle Ø to the side wall, so that axial displacement of the male electrical plug 16 into first substantially hollow receptacle-like member 12 forces the plurality of resilient fingers 20, 21, 22 and 23 radially outward to permit passage of electrical plug 16 past the free ends of the cantilevered resilient fingers 20, 21, 22 and 23 and into the first substantially hollow receptacle-like member 11.

FIG. 6 shows that once the male plug 16 is slid past the ends of the plurality of resilient fingers, the fingers 20, 21, 22 and 23 flex radially inward and engage a rear portion 16*b* of the male elliptical plug 16. In order to prevent withdrawal of plug 16, resilient fingers 20, 21, 22 and 23 should have sufficient stiffness so that when the electrical cord 13 connected to male electrical plug 16 is pulled, the resilient fingers 20, 21, 22 and 23 engage the male electrical plug 16 and prevent withdrawal of the male electrical plug 16 from the first substantially hollow receptacle-like member 12. In the present invention, the resilient fingers 20, 21, 22 and 23 have a curved cross-sectional area which provides further stiffness to prevent accidental withdrawal of plug 16. While the material thickness t can vary depending on the type of material used, the fingers 20, 21, 22 and 23 should have sufficient flexibility so as to be able to flex radially inward to allow passage of a plug threrepast. In addition the fingers should have sufficient resiliency to move radially outward so as to trap the plug 16 within the connector 12. In the embodiment shown, the fingers 20, 21, 22 and 23 extend inward at an angle of about 45 degrees. The use of a cone angle allows withdrawal forces on the electrical plug to be transmitted axially through the fingers 20, 21, 22 and 23. As the fingers 20, 21, 22 and 23 have cone segment shapes, the fingers 20, 21, 22 and 23 have an inherent stiffness to resist withdrawal based on the shape of the fingers. Consequently, the withdrawal of an electrical plug 16 requires an axial compression sufficient to overcome the strength of the material of the fingers 20, 21, 22 and 23 as well as the strength added to the fingers by virtue of the cross sectional shape of the fingers.

FIG. 2 illustrates the invention with plugs 15 and 16 being held in mating condition by the plurality of fingers 20, 21, 22 and 23 on member 12 and the plurality of fingers 30, 31, 32, and 33 on member 11. Thus the present invention provides a cord connector which can be quickly attached to an extension cord without having to disassemble the extension cord.

I claim:

1. An electrical cord connector for holding together a male electrical plug connected to a first electrical cord and a female electrical plug connected to a second electrical cord, comprising:

a first substantially hollow receptacle-like member, said first member having a side wall and a first end with a plurality of resilient fingers cantilevered from said first end, said plurality of resilient fingers positioned at an acute angle to said side wall so that axial displacement of the male electrical plug into said first substantially hollow receptacle-like member can force said plurality of resilient fingers radially outward to permit passage of said electrical plug past said resilient fingers and into the first substantially hollow receptacle-like member and thereby allow the resilient fingers to flex radially inward and engage a rear portion of the male elliptical plug, said resilient fingers having sufficient stiffness so that when the electrical cord connected to said male electrical plug is pulled, the resilient fingers engage the male electrical plug and prevent withdrawal of said male electrical plug from the first substantially hollow receptacle-like member; and a second substantially hollow receptacle-like member, said second member having a side wall and a first end with a plurality of resilient fingers cantilevered from said first end, said plurality of resilient fingers in said substantially hollow receptacle-like member positioned at an acute angle to said side wall of said substantially hollow receptacle-like member so that axial displacement of the female electrical plug into the second substantially hollow receptacle-like member, forces said plurality of resilient fingers in said substantially hollow receptacle-like member radially outward to permit passage of said female electrical plug past said resilient fingers into said second substantially hollow receptacle-like member and thereby allow the resilient fingers in said substantially hollow receptacle-like member to flex radially inward and engage a rear portion of the female electrical plug, said resilient fingers in said substantially hollow receptacle-like member having sufficient stiffness so that when the electrical cord connected to said female electrical plug is pulled the resilient fingers engage a rear portion of the female electrical plug and prevent withdrawal of said female electrical plug from the second substantially hollow receptacle-like like member so that when said first substantially hollow receptacle-like member and said second substantially hollow receptacle-like member are in engagement with each other the male electrical plug and the female electrical plug are secured therein so that a pulling force on either electrical cord will not dislodge the female electrical plug from the male electrical plug.

2. The cord connector of claim 1 wherein the first substantially hollow receptacle-like member and the fingers are of unitary construction.

3. The cord connector of claim 1 wherein the fingers comprise cone segments.

4. The cord connector of claim 1 wherein the first substantially hollow receptable-like member and the second substantially hollow receptacle-like member each include at least two fingers.

5. The cord connector of claim 1 wherein the first substantially hollow receptacle-like member and the second substantially hollow receptacle-like member are made of PVC.

6. The cord connector of claim 1 wherein each of the fingers have a base and an apex with the apex of the fingers defining a central opening.

7. The cord connector of claim 1 wherein the fingers extend inward at an acute angle of about 45 degrees.

8. The cord connector of claim 1 wherein the first substantially hollow receptacle-like member and the second substantially hollow receptacle-like member each have at least four fingers.

9. The cord connector of claim 1 wherein the fingers on the first substantially hollow receptacle-like member and the fingers on the second substantially hollow receptacle-like member define a central opening.

10. The cord connector of claim 1 wherein each of the fingers on the first substantially hollow receptacle-like member have a base and an apex with the base wider than the apex and the base integrally and cantileverly secured to the first substantially hollow receptacle-like member.

* * * * *